US006238117B1

(12) United States Patent
Griebel et al.

(10) Patent No.: US 6,238,117 B1
(45) Date of Patent: May 29, 2001

(54) APPLICATOR DEVICE

(75) Inventors: Ulrich Griebel; Willy Weiss, both of Altdorf; Georg Roeder, Schwabach, all of (DE)

(73) Assignee: Schwan-Stabilo Cosmetics GmbH & Co., Heroldsberg (DE)

( * ) Notice: Subject to any disclaimer, the term of this patent is extended or adjusted under 35 U.S.C. 154(b) by 0 days.

(21) Appl. No.: 09/409,562

(22) Filed: Sep. 30, 1999

(30) Foreign Application Priority Data

Dec. 17, 1998 (DE) ..... 198 58 410
Feb. 5, 1999 (EP) ..... 99102311

(51) Int. Cl.[7] ..... B43K 5/18

(52) U.S. Cl. ..... 401/148; 401/145; 401/151

(58) Field of Search ..... 401/6, 54, 68, 401/145, 148, 152, 153, 156, 169, 151, 171, 172, 173, 174, 175, 176

(56) References Cited

U.S. PATENT DOCUMENTS

| | | | | |
|---|---|---|---|---|
| 2,442,503 | | 6/1948 | Melnikoff et al. . | |
| 3,008,172 | * | 11/1961 | Thompson | 401/149 |
| 3,148,401 | * | 9/1964 | Gilchrist et al. | 401/156 |
| 3,220,044 | * | 11/1965 | Smalley | 401/148 |
| 4,201,491 | * | 5/1980 | Kohler | 401/148 |

FOREIGN PATENT DOCUMENTS

| | | |
|---|---|---|
| 3430582 | 2/1986 | (DE) . |
| 196 27 606 | 1/1998 | (DE) . |
| 925899 | 9/1947 | (FR) . |
| 10-192050 | 7/1998 | (JP) . |

* cited by examiner

*Primary Examiner*—David J. Walczak
(74) *Attorney, Agent, or Firm*—Bachman & LaPointe, P.C.

(57) ABSTRACT

A cosmetic applicator for applying a cosmetic product to the skin has a primary reservoir and a secondary reservoir with a conduit interconnecting the primary reservoir with the secondary reservoir. A flexible member is provided for compressing the cosmetic product for feeding same to an application element.

12 Claims, 2 Drawing Sheets

APPLICATOR DEVICE

BACKGROUND OF THE INVENTION

The invention relates to an arrangement for applying a fluid, pasty or gel-like product onto the skin, having a reservoir for the product, and having an application element which is connected to the reservoir via a feed channel.

Arrangements of the type mentioned in the introduction are known. In the case of known application arrangements, the product is usually fed in portions from the reservoir, by way of the feed channel to the application element, where it is then used up by application. Once such a portion of the product has been used up, then it is necessary to actuate a delivery device which, in the case of the known application arrangements, delivers a further portion of the product to the application element. Such a delivery device may be realized, for example, in that the reservoir has a flexible outer wall which can be compressed (tube), as a result of which the product is delivered out of the reservoir. In the case of other application arrangements, the delivery device is realized in the form of a plunger which is guided with sliding action in the reservoir.

From time to time it is undesirable for the delivery device to be actuated during application because this requires manipulations which disrupt the application operation.

An object of the invention is thus to specify an arrangement of the type given in the introduction in the case of which the product can be fed to the application element without there being any need to actuate a delivery device connected to the reservoir.

SUMMARY OF THE INVENTION

The foregoing object is achieved according to the present invention by a device for reversibly decreasing the volume of the feed channel between the reservoir and the application element.

If the volume of the feed channel is reduced, then the pressure in the feed channel increases, as a result of which product located in the feed channel is fed to the application element. The application element is thus supplied with additional product, although there is no actuation of a delivery device, interacting with the reservoir, for the product. This is because the product which is fed to the application element in such a case comes form the feed channel rather than from the reservoir.

A particularly preferred embodiment of the invention provides for the device for reversibly decreasing the volume of the feed channel to be a device for reversibly reducing the length of the feed channel. In the case of this configuration, handling is simplified to a considerable extent because a reduction in length of the feed channel can be achieved by the application element being pressed against the skin, to be precise by the application arrangement being gripped by way of the reservoir. In such a case, the pressure against the skin will result in the feed channel being shortened and thus in the pressure in the feed channel increasing, and this leads to a corresponding quantity of the product passing out of the feed channel to the application element.

In this case, it is particularly preferred according to the invention for the device for reversibly decreasing the volume of the feed channel to be formed by a folding bellows or a diaphragm. This is because such a folding bellows or such a diaphragm is particularly easy to produce and closes off the feed channel in a sealed manner.

According to the invention, the application element may have a covering which has through-passages for the product and covers an opening of the feed channel in the application element. This means that the product is distributed uniformly over the application device, in accordance with the distribution of the through-passages, as a result of which correspondingly uniform application of the product onto the skin is possible.

In addition, or as an alternative, to the above described features according to the invention, the arrangement according to the invention may also provide for the application element to have a covering which has through-passages for the product and, together with a wall encircling the opening of the feed channel, bounds a space for receiving a predetermined quantity of the product, and the wall encircling the opening of the feed channel is flexible at least in certain areas.

It is also the case with this solution that the volume of the space bounded by the covering and the wall encircling the opening of the feed channel is reduced when the application element is pressed against the skin. This results, in turn, in a corresponding quantity of the product being delivered to the covering and/or through the covering.

The wall encircling the opening of the feed channel is preferably formed by a diaphragm.

A further-preferred embodiment of the invention provides for the covering to be retained in a compliant and/or movable manner such that it can assume at least one operating position in which, together with an annular surface which encloses the opening of the feed channel and is directed toward the covering, it bounds a space for receiving a predetermined quantity of the product, and in which the space decreases upon deformation of the covering and/or movement of the covering.

If, in the case of this configuration, the product is delivered by way of the feed channel, then, rather than passing directly, through the covering, onto the outside of the covering (application surface), it is first of all distributed in the space bounded by the covering and the annular surface. This space thus constitutes an intermediate reservoir. The (uniform) distribution of the product into the intermediate reservoir means that, when delivered further, the product emerges uniformly through the through-passages, irrespective of whether the through-passages are in the vicinity of a feed-channel opening or not.

According to the invention, the covering is preferably made of plastic, metal and/or a ceramic material. It is not least on account of their smooth application surface that these materials have proven successful for cosmetics, also in terms of cleanliness and hygiene.

The covering also preferably has a metal mesh.

According to the invention, the covering may have an eroded, pitted and/or corrugated outer surface. The correspondingly concave structures serve as a further intermediate reservoir.

The covering preferably overlaps an outer border of the application element. This achieves the situation where the application surface is free of disruptive fastening elements, for example a fastening frame. It is thus smooth and free of edges.

According to the invention, the covering is elastic. This means that it always resumes its rest position after use.

The invention particularly preferably provides for the through-passages to be closed in the rest state and to open when the product rests against the same under pressure.

In other words, the through-passages act as a "Bunsen valve". They only open when the product is delivered onto the application surface from the feed channel, but they are otherwise closed, with the result that there is no risk of drying out even when, after use, there is still some product left in the feed channel and/or in the product-receiving space serving as intermediate reservoir. No air passes into the intermediate reservoir through the through-passages either.

The invention may provide for the application surface of the application element to be positioned obliquely in relation to a main axis of the arrangement. Such a configuration is advantageous in terms of handling.

According to the invention, the delivery device provided may be a plunger which seals the reservoir on the side directed away from the application element and is guided with sliding action in the reservoir. In such a case, the delivery of the product from the reservoir to the application element takes place by displacement of the plunger.

In this context, the invention may provide an actuating device for displacing the plunger. An example of such a device is a spindle drive.

BRIEF DESCRIPTION OF THE DRAWINGS

The invention is explained in more detail hereinbelow with further details with reference to the attached drawing, in which.

DETAILED DESCRIPTION

Figure 1:
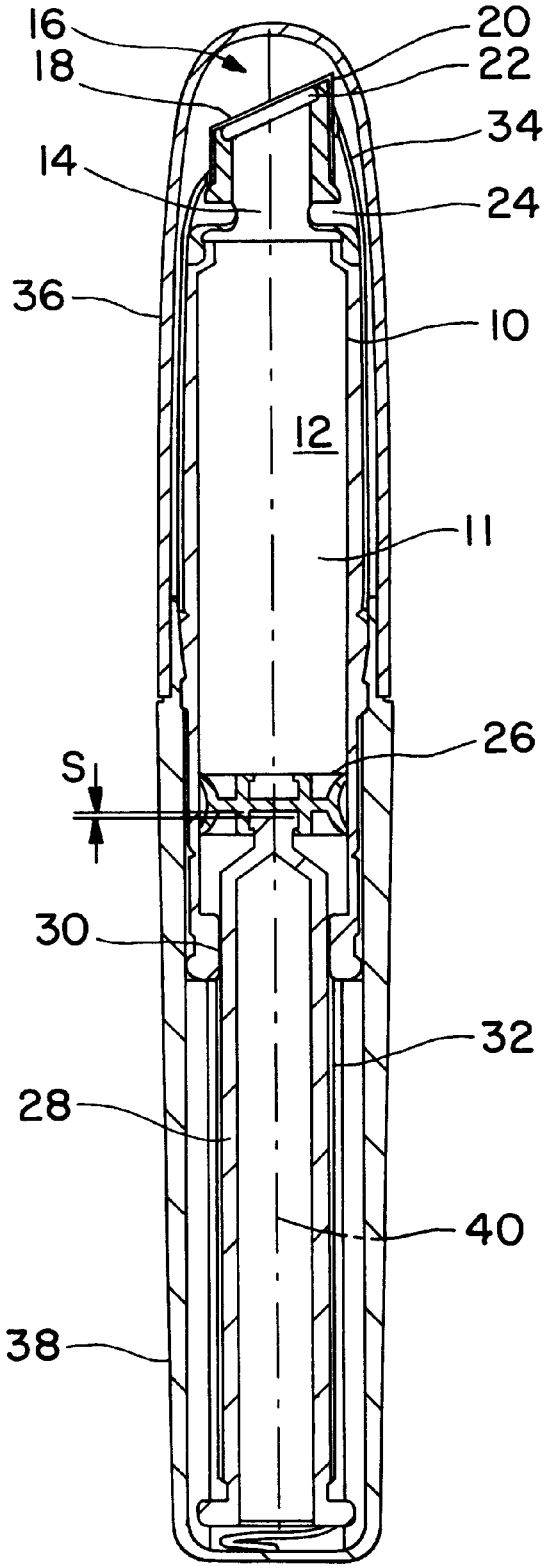
FIG. 1 shows an axial longitudinal section through a first exemplary embodiment of the application arrangement according to the invention.

The exemplary embodiment illustrated in FIG. 1 has a reservoir 10 for a cosmetic product 12. The product may be fluid, pasty or gel-like, a specific example being lipstick.

The reservoir 10 includes a primary reservior 11 which is connected to an application element 16 (having an intermediate or secondary reservior 22) via a feed channel 14 comprising a flexible conduit having a flexible wall. The application element 16 has a convering 18 which together define the secondary reservior 22. The covering 18 is a flexible metal mesh, i.e. a thin metal foil with through-passages. However, the covering 18 may also be made of different materials, for example plastic. In particular in such a case, the through-passages may taper conically to the application surface, with the result that they close of their own accord in a manner of a "Bunsen valve" as long as no pressure is applied from the reservoir. Such configurations are also conceivable in the case of metal coverings.

Together with an annular surface 20 encircling the opening of the feed channel, the covering 18 forms a space 22 which may serve as an intermediate reservoir for the product 12.

The application element 16, which has the feed channel 14 passing through it, has a folding bellows 24 which encircles the feed channel 14 in the form of a ring. This makes it possible for the feed channel to be changed in length and thus in volume.

On the side opposite the application element 16, the reservoir 10 is sealed by a plunger 26 which is guided with sliding action in the reservoir. On that side of the plunger 26 which is directed away from the reservoir 10, the plunger 26 is coupled to a rotary spindle 28 which, on its outside, bears an externally threaded element 32 which meshes with an internally threaded element 30. The coupling is such that play S remains.

In order to protect the folding bellows, a protective sleeve 34 is provided, and a protective cover 36 is also provided. The spindle 28 is coupled for rotation to an actuating sleeve 38, but is retained in an axially displaceable manner in relation to the actuating sleeve 38. A main axis of the application arrangement is designated by the designation 40.

The above described application arrangement functions as follows:

By virtue of rotation on the actuating sleeve 38, the plunger 26 is pushed upward in FIG. 1, as a result of which a corresponding quantity of the product 12 is delivered, by way of the feed channel 14, into the space 22 and thus to the covering provided with the through-passages. In this state, the product 12 can be applied by the covering 18 being brought into contact with the skin. If, in the process, the covering 18 is curved inward by the action of pressure, then (further) product emerges through the through-passages onto the outside of the covering 18. If, however, the space 22 no longer contains any product, then application of (more pronounced) pressure, on account of the folding bellows 24 moving from a rest position to a pressure position, shortens the feed channel 14 and thus reduces the volume of the same, as a result of which the pressure in the feed channel 14 increases and further product 12 is fed to the intermediate reservoir 22 and/or to the covering 18 in an unrestricted manner, where it is available for further application.

That exemplary embodiment of the invention which is illustrated in FIG. 1 has the advantage, in particular, that, when a first quantity of the product 12 has been used up by application, all that is required is for pressure, compressing the folding bellows 24, to be applied to the application element in order for the resulting shortening of the delivery channel 14 to result in further product being delivered into intermediate reservoir 22 and/or to the covering 18. This pressure on the folding bellows 24 can be applied during application. A possibly laborious operation of actuating the actuating sleeve 38 is not necessary.

The folding bellows 24 is indeed compliant, but not elastic. Nevertheless, it is not possible to rule out this situation where the folding bellows 24, once compressed, springs back a little, which could result, in some circumstances, in product 12 which has already been delivered into the intermediate reservoir 22 being sucked out again.

The play S which has already been mentioned is provided as a countermeasure for this. Following actuation of the actuating sleeve for delivering the product 12 in the direction of the application element 16, the actuating spindle 28 butts against the plunger 26. If the folding bellows 24 then springs back a little following the compression, then it is possible to equalize the resulting negative pressure by corresponding movement of the plunger 26 by the amount of play S, as a result of which the product 12 which has already been delivered into the intermediate reservoir 22 is prevented from being sucked out again. The play S can be set in accordance with the elasticity of the folding bellows 24. Furthermore, the use of "Bunsen valves" as through-passages in the covering 18 prevent the product 12 from being sucked out of the intermediate reservoir 22.

Figure 2:
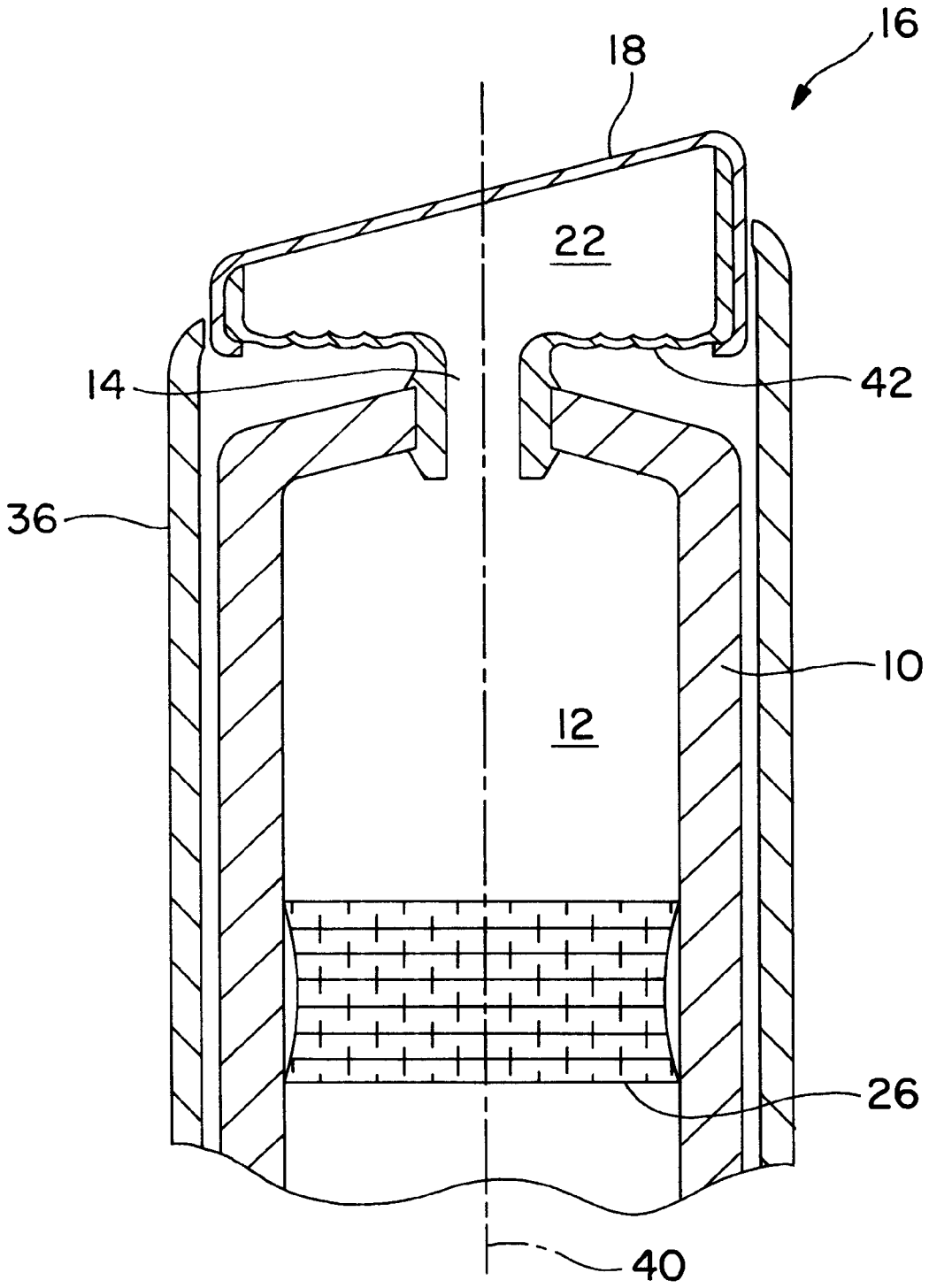
FIG. 2 shows an axial longitudinal section through a second exemplary embodiment of the invention.

In FIG. 2, those components which have also already been illustrated in FIG. 1 are provided with the same designation.

The exemplary embodiment illustrated in FIG. 2 differs from that according to FIG. 1, in particular, in that the folding bellows 24 according to FIG. 1 is replaced by a diaphragm 42, which forms the wall 42, located opposite the covering 18, of the space 22 formed in the application element 16.

If pressure is applied to the application element 16, for example in the axial direction, then the diaphragm 42 yields, as a result of which the volume of the space 22 is decreased. A reduction in volume goes hand-in-hand with an increase in pressure, which has the effect of causing (further) product 12 to be delivered to the covering 18 and/or through the covering 18.

Although not illustrated in FIG. 2, it is also possible, in the case of the exemplary embodiment according to FIG. 2, to provide a device for adjusting the plunger 26.

The features of the invention which have been disclosed in the above description, the claims and the drawing may be essential both individually and in any desired combinations for the purpose of realizing the various embodiments of the invention.

What is claimed is:

1. A cosmetic applicator for applicator for applying a cosmetic product onto skin comprising a primary reservoir, means located within said primary reservoir for decreasing the volume of said primary reservoir, a secondary reservoir, a flexible conduit communicating said secondary reservoir with said primary reservoir for feeding cosmetic product to said secondary reservoir, said secondary reservoir being defined in part by an application element for applying a cosmetic product to the skin, wherein the flow of cosmetic product from said flexible conduit to said secondary reservoir and said application element is unrestricted.

2. A cosmetic applicator for applying a cosmetic product onto skin comprising a primary reservoir, means located within said primary reservoir for decreasing the volume of said primary reservoir, a secondary reservoir, a conduit communicating said primary reservoir with said secondary reservoir, said secondary reservoir being defined in part by an application element for applying a cosmetic product to the skin and a flexible wall for varying the volume of said secondary reservoir for feeding cosmetic product to said application element in an unrestricted manner.

3. The applicator as claimed in claim 1 or 2, wherein the application element has a covering which has through-passages for the cosmetic product.

4. The applicator as claimed in claim 3, wherein the covering is retained in a movable manner such that the volume of the secondary reservoir decreases upon movement of the covering.

5. The applicator as claimed in claim 4, wherein the covering is made of a material selected from the group consisting of plastic, metal and ceramic.

6. The applicator as claimed in claim 5, wherein the covering has a metal mesh.

7. The applicator as claimed in claim 5, wherein the covering is elastic.

8. The applicator as claimed in claim 3, wherein the through-passages are opened when the cosmetic product is under pressure.

9. The applicator as claimed in claim 3, wherein an application surface of the application element is positioned obliquely in relation to a main axis of the applicator.

10. The applicator as claimed in claim 3, wherein said means comprises a plunger which seals the primary reservoir on a side directed away from the application element and is guided with sliding action in the reservoir.

11. The applicator as claimed in claim 10, including an actuating device for displacing the plunger.

12. The applicator as claimed in claim 1, wherein the flexible conduit is moveable from a rest position to a pressure position for feeding said cosmetic product from said flexible conduit to said secondary reservoir.

* * * * *